United States Patent [19]

Lundsgart

[11] 4,040,472

[45] Aug. 9, 1977

[54] CASTING MOULD ADVANCING PLANT

[75] Inventor: Henning Borge Lundsgart, Karlslunde, Denmark

[73] Assignee: Dansk Industri Syndikat A/S, Herlev, Denmark

[21] Appl. No.: 724,695

[22] Filed: Sept. 17, 1976

[30] Foreign Application Priority Data

June 4, 1976 Denmark ..... 2498/76

[51] Int. Cl.[2] ..... B22C 11/08; B22C 19/04; B22C 25/00; B22D 33/04

[52] U.S. Cl. ..... 164/154; 164/323; 164/339; 198/573; 198/575

[58] Field of Search ..... 164/154, 269, 323, 324, 164/329, 330, 339; 198/485, 487, 573, 575

[56] References Cited

U.S. PATENT DOCUMENTS 3,840,066 10/1974 Toccone ..... 164/323

3,955,613 5/1976 Lund ..... 164/324 X

FOREIGN PATENT DOCUMENTS 1,320,606 6/1973 United Kingdom ..... 164/323

*Primary Examiner*—Ronald J. Shore

*Attorney, Agent, or Firm*—Imirie, Smiley & Linn

[57] ABSTRACT

A casting mould consisting of closely collected uniform mould parts is advanced stepwise on a conveyor path by a main piston, exerting an endwise pressure on the endmost mould part, and by an auxiliary mould advancing device incorporating a hydraulic cylinder, the piston of which is greater than said main piston. Hydraulic fluid displaced by the main piston is supplied to the hydraulic cylinder together with additional hydraulic fluid admitted through a differential pressure valve responding on the pressure difference between the two sides of the main piston.

1 Claim, 1 Drawing Figure

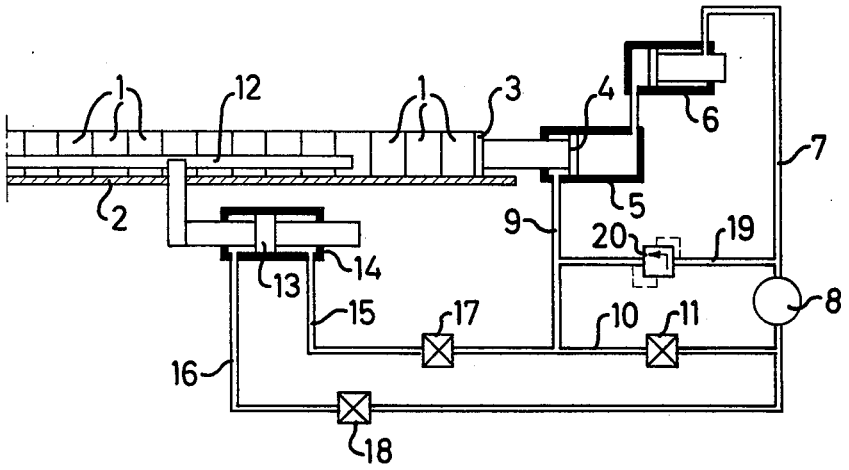
1
12
1
3
4
6
7
2
5
9
20
19
14
13
15
17
10
11
8
16
18

CASTING MOULD ADVANCING PLANT

FIELD OF THE INVENTION

This invention relates to a casting plant of the type where a plurality of uniform mould parts are produced successively in a pressing chamber between a hydraulically operated pressing plate and a counter pressure plate and are transferred to a conveyor path on which they are piled together or successively collected to form a stepwise advanced casting mould comprising one or more casting cavities at each joint between successive mould parts. The conveyor path can be considered to comprise four sections, viz., first a preparatory section where the mould part lastly produced, subsequent to the insertion of cores, if any, is brought into contact with the casting mould already formed, and then a pouring section, a solidification section and a cooling section.

DESCRIPTION OF THE PRIOR ART

The transfer of the newly made mould part to the conveyor path is effected in the manner that subsequent to the pressing chamber having been opened by swinging away the counter pressure plate, the mould part is pushed out of the pressing chamber by means of the pressing plate which also contributes to the stepwise advance of the casting mould on the conveyor path, the first three sections of which preferably is formed by a rigid bed or stationary channel precluding any movement between the mould parts until the castings made have sufficiently solified and cooled.

If the total length of the conveyor path exceeds 4 to 6 meters, the pressure exerted by the pressing plate for advancing the casting mould will normally be of such order as to cause damage to the mould part latest added, and consequently various auxiliaries have been developed for contributing to the advance of the mould so that said pressure can be kept below the value where there is risk of damage to the casting mould. Examples of such auxiliaries have been disclosed in the specification of Danish Pat Nos. 119 373 and 127 494 as well as in the published Danish Pat. application No. 4796/74 where it is assumed that the plant includes a separate driving station for said auxiliaries.

Further, the specification of DT-Off 1 608 040 discloses an arrangement where such separate driving station may be dispensed with. In this case the cooling section of the conveyor path consists of a belt conveyor conventional per se, comprising a pair of rollers, of which at least one is driven by a hydraulic unit fed with hydraulic fluid that has been displaced from the hydraulic cylinder operating the pressing plate. During the displacement of the newly formed mould part, and prior to its being added to the casting mould already formed, the displaced hydraulic liquid is returned directly to the main pump of the plant via a switch valve which is controlled by a photocell that responds at the moment when the mould part contacts the existing mould. During this phase the conveyor belt is consequently stationary. Subsequent to the addition of the mould part, causing the switching of the valve, the displaced hydraulic fluid is fed to the hydraulic unit of the conveyor which drives the belt via a gear which is so adapted to the volumetric capacity of the hydraulic unit as to provide synchronization between the movements of the belt and the pressing plate, respectively.

However, this proposed arrangement is scarcely practically feasible. In any case it is imperative that the valve is switched at the proper time because delayed switching will result in crushing of one or more mould parts, whereas premature switching will result in opening of the mould at the transition from the stationary channel to the belt conveyor. If measures be taken to safeguard that the switching of the valve is effected at just the proper time, it should be possible to attain the desired synchronism during the initial advance movement of the casting mould but during the braking or deceleration phase the hydraulic drive pressure which was required during the acceleration phase, will result in an expansion which again will cause the mould to be opened or separated. Under certain conditions this may per se be acceptable in practice but any opening or separation between successive mould parts will necessarily be followed by a reclosure under a certain impact and, consequently, with the risk of pressure deformation of the mould parts and the castings.

SUMMARY OF THE INVENTION

The present invention has for its object to provide a conveying mechanism by means of which it is possible, when adjoining each newly made mould part to the already existing casting mould, to ensure a desired contact pressure or weighting between said mould part and the already existing casting mould throughout the entire conveying phase, and to maintain such weighting through the length of casting mould so that the risk of mould opening as well as mould deformation can be precluded during the entire advance movement.

Taking its basis on the prior art last-mentioned, the invention relates to a plant for stepwise advancing a casting mould comprising uniform mould parts which are closely piled together on a conveyor path having a preparatory section where the mould parts are successively added to the already existing casting mould be means of a hydraulically operated main piston, followed by pouring, solidification and cooling sections, of which at least the last-mentioned section includes a mould advancing device which during the advance steps is moved synchroneously with the main piston by means of at least one hydraulic unit fed with hydraulic liquid displaced by the main piston. The plant according to the invention differs from the known embodiment of this type in that the hydraulic unit of the mould advancing device is formed by a hydraulic cylinder with a piston, the effective area of which exceeds the effective displacement area of the main piston, said cylinder being connected to the main pump of the plant via a pipe including a differential pressure valve for supplying additional hydraulic liquid to the hydraulic cylinder when the pressure difference between the two sides of the main piston exceeds a preset value.

The difference in area between the two pistons may expediently be of the order of 10% so that equally long travels of both pistons imply that the hydraulic liquid displaced by the main piston and operating the hydraulic cylinder must be correspondingly supplemented. This is effected via the pressure differential valve which, however, does not open until a certain pressure difference has built up between the two sides of the main piston which again implies an increased resistance to the travel of this piston, i.e. a resistance in excess of that occurring during the transfer phase, and which is mainly owing to the frictional resistance to the displacement of the newly made mould part on its way to the already existing casting mould on the conveyor path. During this transfer phase, the liquid displaced by the main piston returns to the main pump of the plant via a shut-off valve, open in this situation, whereas the hydraulic cylinder is isolated by means of two other closed valves. At the moment of collision, the resistance to the movement of the main piston increases abruptly so as to cause an increase in pressure between the main pump and said piston which can be utilized for switching the three shut-off valves subsequent to the desired weighting of the mould part lastly adjointed having been achieved. Now the mould advancing device will transfer part of the force required for the displacement to the casting mould but the difference in area between the two pistons will in conjunction with the differential pressure valve cause the main piston to keep the mould parts pressed together at a preset contact pressure (weighting) also during this phase so that mould opening or separation as well as mould deformation as a consequence of excess loads or braking forces can be precluded.

BRIEF DESCRIPTION OF THE DRAWING

The drawing illustrates diagrammatically an embodiment of the plant during the last-mentioned phase, i.e. while the casting mould comprising uniform, closely collected mould parts is being displaced to the left on the conveyor path which has been indicated as a stationary bed or supporting plate.

DESCRIPTION OF THE PREFERRED EMBODIMENT

During the preceeding phase — the phase of transfer — right-hand mould part 1 lastly produced has been transferred from a pressing chamber, not shown, to the conveyor path 2 and adjoined to the casting mould by a movement of displacement brought about by a pressing plate 3 which connects rigidly to a piston 4 of a main cylinder 5 which in its turn connects to a main pump 8 via an accumulator cylinder 6 and a pipe 7. During the phase of transfer, the left-hand end of the cylinder 5 is connected to the inlet of the pump 8.

The conveyor path 2 is associated with a mould advancing device which in the embodiment shown, and as known per se, comprises a pair of reciprocating side rails 12 which can be brought into, and out of, motion-transferring engagement with the sides of casting mould 1,1. This mould advancing device is reciprocated by a piston 13 of a hydraulic cylinder 14 which at its ends connects via pipes 15 and 16 including shut-off valves 17 and 18, to the outlet pipe 9 of the main cylinder 5 and the inlet of the pump 8, respectively. The effective area of the piston 13 is somewhat larger than the corresponding area of the left-hand side of the main piston 4.

During the phase of transfer, the valves 17 and 18 are closed and, consequently, the mould advancing device 12 is stationary.

Further, the drawing shows a connecting pipe 19 including a differential pressure valve 20 between the two pipes 7 and 8. This valve is also closed during the transfer phase.

At the end of this phase the pressure in the pipe 7 increases, and this increase in pressure is utilized to cause switching of the valves 11,17 and 18 so as to permit the liquid displaced by main piston 4 to flow through the pipes 9 and 15 to the right-hand end of the hydraulic cylinder 14. Any liquid discharged from this cylinder returns to the pump 8 via the pipe 16.

At a certain drop in pressure across the main piston 4, i.e. between the pipes 7 and 9, the differential pressure valve 20 opens, and the hydraulic cylinder 14 is now through this channel supplied with additional pressure liquid from the pump 8. Now, the main piston 4 and the mould advancing device 12 work together for displacing the casting mould 1,1 one step to the left on the conveyor path, and at the same time the pressure exerted by the piston 4 keeps the mould parts 1 together to a desired extent dependent on the difference in piston areas.

The differential pressure valve 20 may expediently be of the type where the difference in pressure required for opening the valve varies with the pressure level in such a way as to compensate for the gland friction, dependent on the pressure, in the cylinders of the plant so that the driving force applied to the casting mould is set by adjusting the differential pressure valve.

In practice the plant may further include provisions for returning the pistons 4 and 13 and, preferably, also provisions for operating the mould advancing device 12 independently of main cylinder 5 with a view to emptying conveyor path 2 of mould parts, but these provisions are considered irrelevant to the invention and have, therefore, together with other secundary details not been shown in the drawing.

I claim:

1. A plant for stepwise advancing a casting mould comprising uniform mould parts which are closely piled together on a conveyor path having a preparatory section where the mould parts are successively added to the already existing casting mould by means of a hydraulically operated main piston, followed by pouring, solidification and cooling sections, of which at least the last-mentioned section includes a mould advancing device which during the advance steps is moved synchroneously with the main piston by means of at least one hydraulic unit fed with hydraulic liquid displaced by the main piston, wherein the hydraulic unit of the mould advancing device is a hydraulic cylinder with a piston, the effective area of which exceeds the effective displacement area of the main piston, said cylinder being connected to the main pump of the plant via a pipe including a differential pressure valve for supplying additional hydraulic liquid to the hydraulic cylinder when the pressure difference between the two sides of the main piston exceeds a preset value.

* * * * *